US007215350B2

(12) United States Patent
Torisawa

(10) Patent No.: US 7,215,350 B2
(45) Date of Patent: May 8, 2007

(54) THERMAL DEVELOPING EQUIPMENT

(75) Inventor: Nobuyuki Torisawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 224 days.

(21) Appl. No.: 11/092,729

(22) Filed: Mar. 30, 2005

(65) Prior Publication Data

US 2005/0220493 A1 Oct. 6, 2005

(30) Foreign Application Priority Data

Mar. 30, 2004 (JP) ..... P.2004-099277

(51) Int. Cl.
*G03D 13/00* (2006.01)

(52) U.S. Cl. ..... 347/140; 355/27; 430/350; 396/575

(58) Field of Classification Search ..... 430/350–352; 355/27; 347/140, 212, 224; 396/575
See application file for complete search history.

(56) References Cited

U.S. PATENT DOCUMENTS 6,297,476 B1 * 10/2001 Kashino et al. ..... 219/216

FOREIGN PATENT DOCUMENTS

JP 8-29954 A 2/1996

* cited by examiner

*Primary Examiner*—Huan Tran
(74) *Attorney, Agent, or Firm*—Sughrue Mion, PLLC

(57) ABSTRACT

A thermal developing equipment including a conveying unit for conveying a sheet-like photosensitive material and a heating unit for thermally treating a latent image formed on an image forming layer of the photosensitive material to be conveyed by the conveying unit, thereby visualizing it, wherein the heating unit is divided into plural regions which can be independently temperature controlled in the width direction of the photosensitive material perpendicular to the conveying direction of the photosensitive material; plural position detection sensors aligned along the width direction of the photosensitive material are provided in the upstream side of the heating unit; and a temperature control unit for controlling the temperature of the heating unit controls the temperature of each of the regions of the heating unit corresponding to an output of the position detection sensor.

11 Claims, 2 Drawing Sheets

THERMAL DEVELOPING EQUIPMENT

This application is based on Japanese Patent application JP 2004-099277, filed Mar. 30, 2004, the entire content of which is hereby incorporated by reference. This claim for priority benefit is being filed concurrently with the filing of this application.

BACKGROUND OF THE INVENTION

1. Technical Field of the Invention

The present invention relates to a thermal developing equipment to be used while inserting thermal development photosensitive materials (hereafter often referred to as "photosensitive materials") of various sizes at random.

2. Description of the Related Art

A thermal developing equipment is provided with a conveying unit for conveying a sheet-like photosensitive material and a heating unit for applying heat to the photosensitive material to be conveyed, thereby visualizing a latent image formed on an image forming layer of the photosensitive material. In this case, since the heating unit must apply heat uniformly in the width direction of the photosensitive material, it must be properly temperature managed. For example, in the heating unit, since there is some possibility that a difference in the temperature is generally caused between the center portion and the both end portions in the width direction of the photosensitive material, it is performed to make the temperature distribution of the whole uniform by dividing the heating unit into plural temperature control regions in the width direction of the photosensitive material and carrying out the temperature management in every region (for example, see JP-A-8-29954).

However, in the thermal developing equipment to be used while inserting photosensitive materials of various sizes at random in plural positions in the width direction of the photosensitive material, for example, the region through which the photosensitive material passes does not become constant. Accordingly, only by performing the foregoing simple temperature control in every region, there is encountered such a problem that it is impossible to stabilize the temperature control. The invention was carried out taking into consideration the foregoing circumstances.

SUMMARY OF THE INVENTION

An object of the invention is to provide a thermal developing equipment capable of stabilizing the temperature control of a heating unit even when photosensitive materials of various sizes are inserted at random.

The foregoing object is achieved by the following constructions.

(1) A thermal developing equipment comprising a conveying unit for conveying a sheet-like thermal development photosensitive material and a heating unit for thermally treating a latent image formed on an image forming layer of the thermal development photosensitive material to be conveyed by the conveying unit, thereby visualizing it, wherein the heating unit is divided into plural regions which can be independently temperature controlled in the width direction of the thermal development photosensitive material perpendicular to the conveying direction of the thermal development photosensitive material; plural position detection sensors aligned along the width direction of the thermal development photosensitive material are provided in the upstream side of the heating unit; and a temperature control unit for controlling the temperature of the heating unit controls the temperature of each of the regions of the heating unit corresponding to an output of the position detection sensor.

(2) The thermal developing equipment as set forth above in (1), wherein the temperature control unit determines a material size of the thermal development photosensitive material by the output of the position detection sensor and controls the temperature of each of the regions of the heating unit based on the material size.

(3) The thermal developing equipment as set forth above in (1) or (2), wherein a monitor unit for detecting a starting end and a terminal end of the thermal development photosensitive material based on the output of the position detection sensor, thereby monitoring the conveying state of the thermal development photosensitive material is provided.

(4) The thermal developing equipment as set forth above in any one of (1) to (3), wherein a distance L1 from the position detection sensor to an inlet of the heating unit is set up longer than the product of a conveying rate of the thermal development photosensitive material and a temperature control response time of the heating unit.

(5) The thermal developing equipment as set forth above in any one of (1) to (3), wherein a distance L2 from the position detection sensor to the position on the heating unit where the thermal development photosensitive material reaches the development temperature is set up longer than the product of a conveying rate of the thermal development photosensitive material and a temperature control response time of the heating unit.

(6) The thermal developing equipment as set forth above in any one of (1) to (5), wherein plural light emitting units aligned in the width direction of the thermal development photosensitive material are provided in an insertion port for the thermal development photosensitive material into the conveying unit, and a lighting control unit which lighting controls the light emitting units corresponding to a developable region kept at a prescribed value of the temperature of the heating unit is provided.

(7) The thermal developing equipment as set forth above in any one of (1) to (6), wherein the position detection sensor comprises an optical sensor capable of emitting light having a wavelength at which the thermal development photosensitive material is non-sensitive.

(8) The thermal developing equipment as set forth above in any one of (1) to (6), wherein the position detection sensor comprises of a mechanical sensor such as a limit switch.

According to the invention as set for the above in (1), the insertion position of the photosensitive material (thermal development photosensitive material) is detected by the position detector sensors aligned in the width direction of the photosensitive material, and the temperature in each of the regions of the heating unit is controlled corresponding to the output of the position detection sensor. Accordingly, it is possible to properly manage the temperature of only the region on the heating unit through which the photosensitive material passes without waste.

According to the invention as set forth above in (2), the size of the photosensitive material is determined by the output of the position detection sensor, and the temperature of each of the regions of the heating unit is controlled based on that material size. Accordingly, it is possible to properly manage the temperature of only the region adaptive to the size without waste. Also, it is possible to easily display the size in some way.

According to the invention as set forth above in (3), the starting end and the terminal end of the photosensitive material are detected based on the output of the position detection sensor, thereby monitoring the conveying state of the photosensitive material. Accordingly, it is possible to simply discover abnormal conveying.

According to the invention as set forth above in (4), the distance L1 from the position detection sensor to the inlet of the heating unit is set up longer than the product of the conveying rate of the photosensitive material and the temperature control response time of the heating unit. Accordingly, it is possible to make the photosensitive material reach the inlet of the heating unit at the point of time when the temperature control has been surely carried out.

According to the invention as set forth above in (5), the distance L2 from the position detection sensor to the position on the heating unit where the thermal development photosensitive material reaches the development temperature is set up longer than the product of the conveying rate of the photosensitive material and the temperature control response time of the heating unit. Accordingly, it is possible to make the photosensitive material reach a point of ensuring the development temperature on the heating unit at the point of time when the temperature control has been surely carried out.

According to the invention as set forth above in (6), the light emitting units are lighting controlled corresponding to the developable region on the heating unit. Accordingly, even in the case where a photosensitive material is manually inserted and set in advance, it is possible to correctly insert the photosensitive material into a region where the proper temperature control is carried out.

According to the invention as set forth above in (7), the optical sensor capable of emitting light having a wavelength at which the thermal development photosensitive material is non-sensitive is used. Accordingly, it is possible to detect the insertion position of the photosensitive material with a simple structure without anxiety of making the photosensitive material sensitive to light.

According to the invention as set forth above in (8), the mechanical sensor such as a limit switch is used as the position detection sensor. Accordingly, it is possible to detect the insertion position of the photosensitive material without anxiety of making the photosensitive material sensitive to light.

DETAILED DESCRIPTION OF THE INVENTION

Preferred embodiments of the invention will be described below with reference to the drawings.

Figure 1:
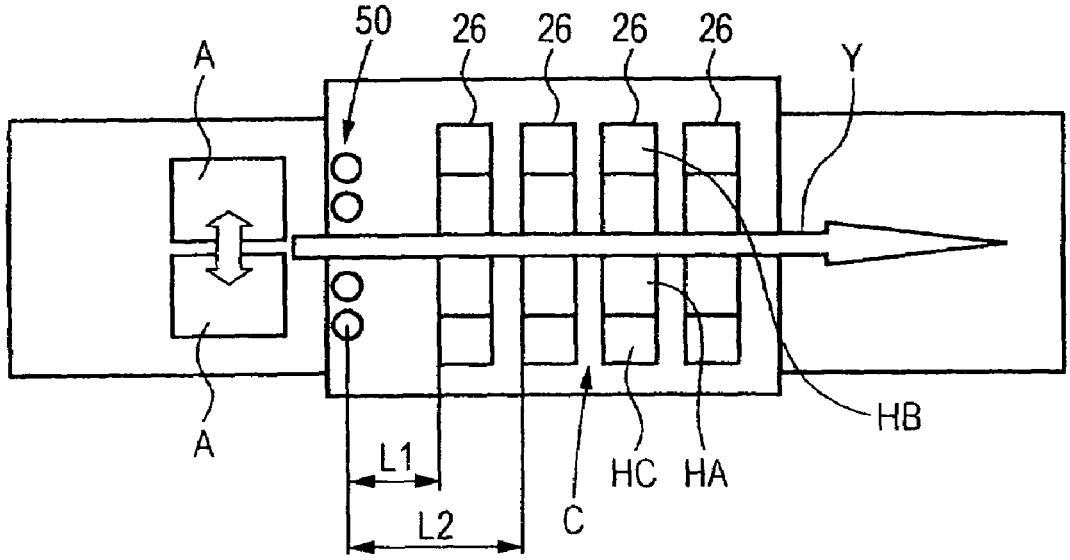
FIG. 1 is a plan view showing the development of a major portion of a thermal developing equipment according to one embodiment of the invention.

FIG. 1 is a plan view showing the development of a major portion of a thermal developing equipment according to one embodiment of the invention. This thermal developing equipment is provided with a conveying unit (the illustration of which is omitted) for conveying a sheet-like thermal development photosensitive material (hereinafter referred to as "photosensitive material") A and a heating unit (thermal developing section) C for thermally treating a latent image formed on an image forming layer of the photosensitive material A to be conveyed in the conveying direction Y by the conveying unit, thereby visualizing it.

The heating unit C has plural heating plates 26 which are provided dividedly in multiple stages along a conveying direction Y. Also, the heating plate 26 in each stage is divided into plural regions HA, HB and HC which can be independently temperature controlled in the width direction of the photosensitive material perpendicular to the conveying direction Y of the photosensitive material A. Here, the heating plate 26 is divided into a central region HA having a large width and both end regions HB and HC having a small width.

In an insertion port for the photosensitive material located in the upstream side of the heating unit C, plural position detection sensors 50 aligned along the width direction of the photosensitive material are provided. These position detection sensors 50 are constructed of an optical sensor which emits light having a wavelength at which the thermal development photosensitive material is non-sensitive, or a mechanical sensor such as a limit sensor.

Also, this thermal developing equipment is provided with a non-illustrated temperature control unit capable of independently controlling the temperature of the heating plate 26 of each stage of the heating unit C in every regions HA, HB and HC. This temperature control unit has a function so as to detect the size and insertion position of the photosensitive material A based on an output of the position detection sensor 50 and to control the temperature of the heating plate 26 of each stage constructing the heating unit C in every regions HA, HB and HC based on the detected size data and insertion position data.

Also, this thermal developing equipment is provided with a non-illustrated monitoring unit for detecting a starting end and a terminal end of the photosensitive material A based on the output of the position detection sensor 50, thereby monitoring the conveying state of the photosensitive material A. Also, a distance L1 from the position detection sensor 50 to an inlet of the heating unit C is set up longer than the product of a conveying rate of the photosensitive material A and a temperature control response time of the heating unit C. Alternatively, a distance L2 from the position detection sensor 50 to the position on the heating unit C where the photosensitive material A reaches the development temperature is set up longer than the product of a conveying rate of the photosensitive material A and a temperature control response time of the heating unit C.

In this way, the insertion position and size of the photosensitive material A are detected by the position detection sensor 50 aligned in the width direction of the photosensitive material, thereby controlling the temperature of each of the regions HA, HB and HC of the heating unit C corresponding to that output. Accordingly, it is possible to properly manage the temperature of only the region on the heating unit C through which the photosensitive material A passes without waste, thereby stabilizing the temperature control. Incidentally, since the size of the photosensitive material A becomes known, it is possible to easily display the size in some way. For example, the thermal development equipment may include a display unit for displaying the size of the photosensitive material detected by the position detection sensor 50.

Also, since the monitoring unit detects a starting end and a terminal end of the photosensitive material A based on the output of the position detection sensor 50, thereby monitoring the conveying state of the photosensitive material A, it is possible to simply discover abnormal conveying and to immediately deal therewith.

Also, when the distance L1 from the position detection sensor 50 to an inlet of the heating unit C is set up longer than the product of a conveying rate of the photosensitive material A and a temperature control response time of the heating unit C, it is possible to make the photosensitive material A reach the inlet of the heating unit C at the point of time when the temperature control has been surely carried out. Also, when a distance L2 from the position detection sensor 50 to the position on the heating unit C where the photosensitive material A reaches the development temperature is set up longer than the product of a conveying rate of the photosensitive material A and a temperature control response time of the heating unit C, it is possible to make the photosensitive material A reach a point of ensuring the development temperature on the heating unit C at the point of time when the temperature control has been surely carried out. Thus, it is possible to ensure a constant development quality.

Also, since the optical sensor capable of emitting light having a wavelength at which the thermal development photosensitive material is non-sensitive, or the mechanical sensor such as a limit switch is used as the position detection sensor 50, it is possible to detect the insertion position of the photosensitive material A without anxiety of making the photosensitive material A sensitive to light.

Figure 2:
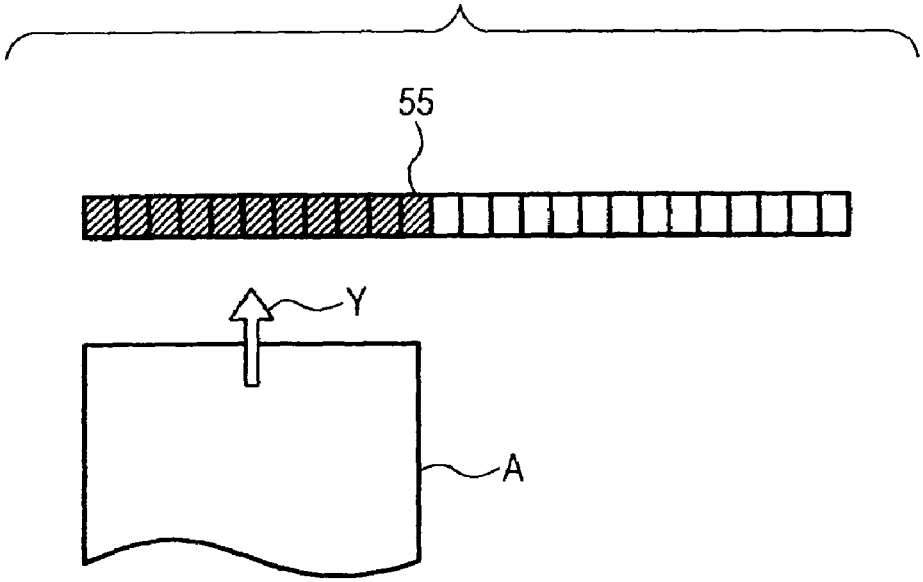
FIG. 2 is an enlarged view of a major portion according to another embodiment of the invention.

Also, as illustrated in FIG. 2, by employing a construction in which plural light emitting units (LED) 55 aligned in the width direction of the photosensitive material A are provided in an insertion port for the photosensitive material A into the conveying unit, and a lighting control unit (the illustration of which is omitted) which lighting controls the light emitting units 55 corresponding to a developable region kept at a prescribed value of the temperature of the heating unit C is provided, even in the case where a photosensitive material is manually inserted and set in advance, or the photosensitive materials A of various sizes are continuously inserted at random, thereby generating heating regions having a different temperature in the width direction of the photosensitive material, it is possible to correctly insert the photosensitive material A into a region where the proper temperature control is carried out, and therefore, there is no anxiety of causing dropping of the development quality.

Figure 3:
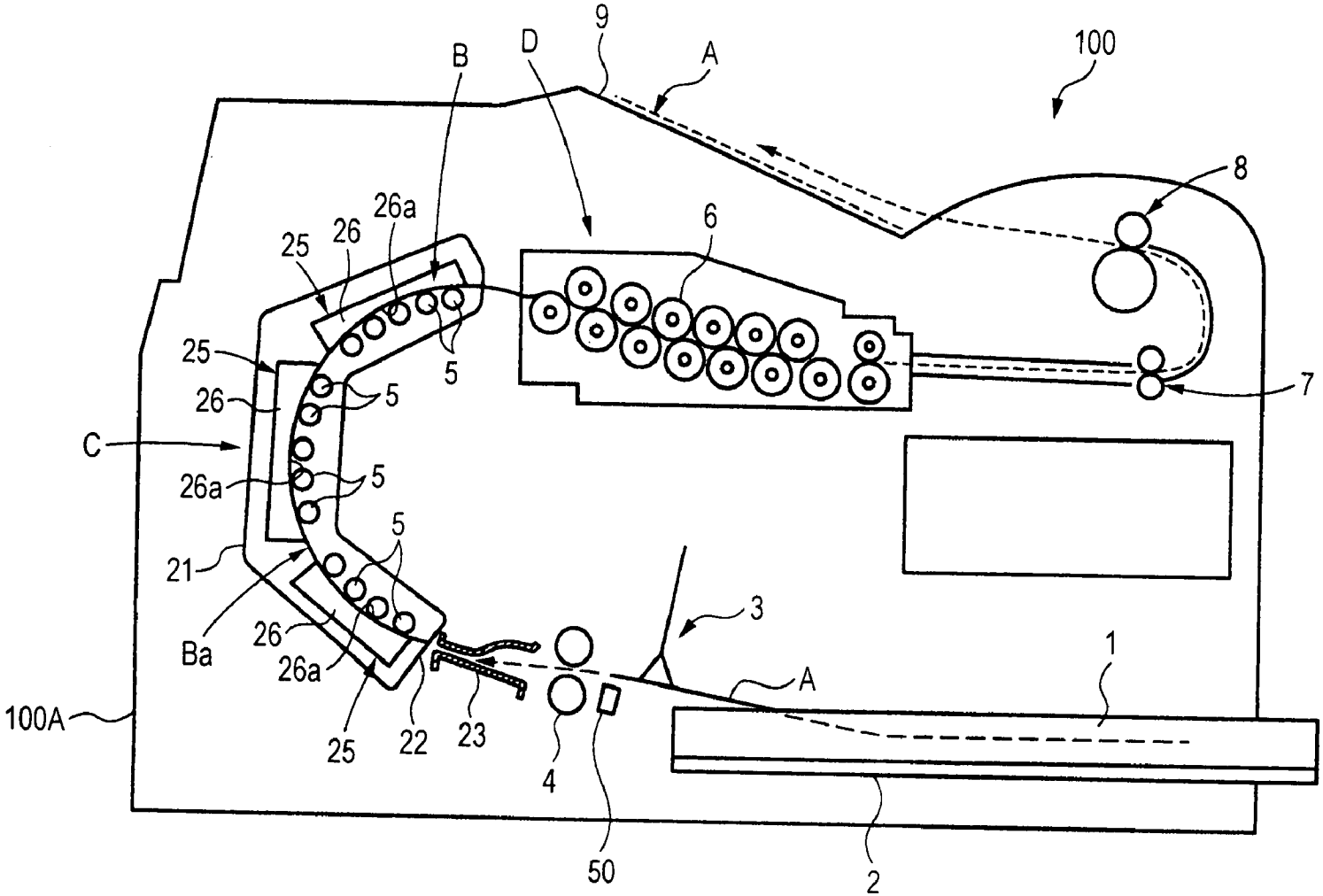
FIG. 3 is a side view to show a schematic construction of a thermal developing equipment according to the embodiment of the invention.

FIG. 3 is a schematic side view to show the overall construction of the foregoing thermal developing equipment. The photosensitive material A to which this thermal developing equipment 100 is subjective is a film-like material comprising an image forming layer containing a light-sensitive silver halide, a non-light-sensitive organic silver salt, a reducing agent, and a binder formed on at least one surface of a support. This photosensitive material A is carried in the thermal developing equipment 100 in the state that it is exposed with laser beam in another place to form a latent image and housed in a cassette 1.

For that reason, the thermal developing equipment 100 is provided with a loading section (insertion table) 2 for detachably loading the cassette 1 having the photosensitive material A housed therein, and an ejection mechanism 3 (such as suckers) for ejecting the photosensitive material A from the cassette 1 loaded in the loading section 2 is provided in the vicinity of the loading section 2.

Inside a main body 100A of the thermal developing equipment 100, a conveying mechanism B for sending and moving the photosensitive material A which has been ejected by the ejection mechanism 3 in a fixed direction along a prescribed conveying passage Ba is provided. Also, a thermal developing section (corresponding to the foregoing heating unit) C and a slow cooling section D are provided in this order from the upstream side along the conveying passage Ba. The thermal developing section C is a section for heating the photosensitive material A, thereby performing thermal development (visualizing a latent image), and the slow cooling section D is a section for slowly cooling the photosensitive material A having been heated due to the thermal development.

The conveying mechanism B of the photosensitive material A is of a roll type and constructed of insertion rolls 4 aligned in the upstream end which is the nearest to the ejection mechanism 3, a number of press rolls 5 put in the thermal developing section C, a number of slow cooling rolls 6 put in the slow cooling section D, discharge rolls 7 and 8 for discharging the photosensitive material A which has come out from the slow cooling section D into a tray 9 in the upper portion of the main body 100A, and a drive mechanism (the illustration of which is omitted) for driving the rolls 4 to 8. The foregoing position detection sensors 50 are aligned in the upstream portion of this conveying mechanism B.

The thermal developing section C is entirely covered by a casing 21, and an insertion portion 22 for the photosensitive material A is provided in the upstream end thereof. Also, an insertion guide 23 for smoothly introducing the photosensitive material A into the thermal developing section C is provided between this insertion portion 22 and the insertion rolls 4.

Also, three blocks of developing units 25 are provided in the arc form within the casing 21 of the thermal developing section C. The developing units 25 are each constructed of a heating plate 26 in which one surface thereof (the surface opposing to the photosensitive material A) is a heating surface 26*a* in the arc form and the plural press rolls 5 which sandwich the photosensitive material A together with the heating surface 26*a*. In this case, the press rolls 5 also work as a constructive element of the conveying mechanism B.

The heating plates 26 are respectively heated by a non-illustrated heater, and the control temperature can be changed in each block unit as the need arises. Also, the temperature distribution can be adjusted in the plural regions divided in the width direction of the photosensitive material in each block.

When the thermal developing section C is constructed in this way, the photosensitive material A having been inserted from the insertion portion 22 of the developing unit 25 is heated while being conveyed at a prescribed conveying rate, whereby it receives a quantity of heat necessary for the development and is thermally developed until it is discharged from the thermal developing section C.

In the case where the photosensitive material A is thermally developed in this thermal developing equipment 100, the photosensitive material A is conveyed along the conveying passage Ba, and heat is applied to the photosensitive material A in the thermal developing section C while conveying the photosensitive material A, thereby visualizing a latent image. The thermally developed photosensitive material A moves from the thermal developing section C into the slow cooling section D, and after slowly cooling in the slow cooling section D, the photosensitive material A is discharged into the tray 9 by the discharge rolls 7 and 8.

During such a series of actions, the insertion position and size of the photosensitive material A are detected by the position detection sensors 50 at the point of time of taking out the photosensitive material A from the cassette 1 and inserting the tip end of the photosensitive material A into the insertion port of the thermal developing section C, and the temperature distribution of the thermal developing section C is controlled according to the obtained data.

Incidentally, in the foregoing embodiment, the case of housing every one sheet of the photosensitive material A in the cassette A and taking out it has been described. But, plural sheets of the photosensitive material A having a latent image formed thereon may be housed together in a magazine and fed into the thermal developing section B.

What is claimed is:

1. A thermal developing equipment comprising:

a conveying unit for conveying a thermal development photosensitive material;

a heating unit for heating a latent image formed on an image forming layer of the material to be conveyed by the conveying unit, thereby visualizing the latent image, wherein the heating unit is divided into plural regions which can be independently temperature controlled in a width direction of the material perpendicular to a conveying direction of the material, and the heating unit comprises plural position detection sensors aligned along the width direction in an upstream side of the heating unit; and a temperature control unit for controlling a temperature of the heating unit which controls a temperature of each of the plural regions corresponding to an output of the position detection sensor.

2. The thermal developing equipment according to claim 1, wherein the temperature control unit determines a size of the material by the output of the position detection sensor and controls the temperature of each of the plural regions based on the size.

3. The thermal developing equipment according to claim 2, which further comprises a display unit for displaying the size of the material obtained by the output of the position detection sensor.

4. The thermal developing equipment according to claim 1, which further comprises a monitor unit for detecting at least one of a starting end and a terminal end of the material based on the output of the position detection sensor, thereby monitoring a conveying state of the material.

5. The thermal developing equipment according to claim 1, wherein a distance from the position detection sensor to an inlet of the heating unit is set up longer than a product of a conveying rate of the material and a temperature control response time of the heating unit.

6. The thermal developing equipment according to claim 1, wherein a distance from the position detection sensor to a position on the heating unit where the material reaches a development temperature is set up longer than a product of a conveying rate of the material and a temperature control response time of the heating unit.

7. The thermal developing equipment according to claim 1, which further comprises: plural light emitting units aligned in the width direction in an insertion port for the material into the conveying unit; and a lighting control unit which lighting controls the light emitting units corresponding to a developable region kept at a value of the temperature of the heating unit.

8. The thermal developing equipment according to claim 1, wherein the position detection sensor comprises an optical sensor capable of emitting light having a wavelength at which the material is non-sensitive.

9. The thermal developing equipment according to claim 1, wherein the position detection sensor comprises a mechanical sensor.

10. The thermal developing equipment according to claim 9, wherein the mechanical sensor is a limit switch.

11. The thermal developing equipment according to claim 1, wherein the thermal development photosensitive material is a sheet-like material.

* * * * *